US012767288B2

(12) United States Patent
Claes

(10) Patent No.: US 12,767,288 B2
(45) Date of Patent: Oct. 20, 2026

(54) TRANSPORT SHIP COMPRISING A TRIM CONTROL SYSTEM WHICH IS NOT IN COMMUNICATION WITH THE SEA

(71) Applicant: GAZTRANSPORT ET TECHNIGAZ, Saint-Remy-les-Chevreuse (FR)

(72) Inventor: Lorenz Claes, Saint-Remy-les-Chevreuse (FR)

(73) Assignee: GAZTRANSPORT ET TECHNIGAZ, Saint-Remy-les Chevreuse (FR)

( * ) Notice: Subject to any disclaimer, the term of this patent is extended or adjusted under 35 U.S.C. 154(b) by 301 days.

(21) Appl. No.: 18/696,254

(22) PCT Filed: Sep. 30, 2022

(86) PCT No.: PCT/EP2022/077370
§ 371 (c)(1),
(2) Date: Mar. 27, 2024

(87) PCT Pub. No.: WO2023/052626
PCT Pub. Date: Apr. 6, 2023

(65) Prior Publication Data

US 2024/0391565 A1 Nov. 28, 2024

(30) Foreign Application Priority Data

Sep. 30, 2021 (FR) ..... 2110347

(51) Int. Cl.
*B63B 39/03* (2006.01)
*B63B 25/16* (2006.01)
(Continued)

(52) U.S. Cl.
CPC ..... *B63B 39/03* (2013.01); *B63B 25/16* (2013.01); *B63B 43/06* (2013.01); *B63B 2025/085* (2013.01); *B63B 2025/087* (2013.01)

(58) Field of Classification Search
CPC ..... B63B 39/03; B63B 25/16; B63B 43/06; B63B 2025/085; B63B 2025/087
See application file for complete search history.

(56) References Cited

U.S. PATENT DOCUMENTS 3,470,840 A 10/1969 Pangalila
2022/0204144 A1* 6/2022 Claes ..... B63B 39/03

FOREIGN PATENT DOCUMENTS

GB 2044201 A 10/1980
KR 101148067 B1 5/2012
(Continued)

OTHER PUBLICATIONS

Chauveau, Jean-Claude; WO 2018206653 Machine Translation; 2018 (Year: 2018).*
(Continued)

*Primary Examiner* — Benjamin F Fiorello
(74) *Attorney, Agent, or Firm* — Notaro, Michalos & Zaccaria P.C.

(57) ABSTRACT

A trim control system not in communication with the sea for a transport ship. The trim control system has a front liquid tank, a rear liquid tank, a roll-stabilizing tank that includes a pair of partition walls arranged to slow a flow of liquid in the roll-stabilizing tank along the transverse axis of the transport ship, and a distribution device. The distribution device is in communication with the front liquid tank, the rear liquid tank, and the roll-stabilizing tank, and is designed to distribute a volume of liquid therebetween.

19 Claims, 11 Drawing Sheets

(51) Int. Cl.
*B63B 43/06* (2006.01)
*B63B 25/08* (2006.01)

(56) References Cited

FOREIGN PATENT DOCUMENTS

WO WO-2018206653 A1 * 11/2018 ..... B63B 39/03
WO 2020012113 A1 1/2020

OTHER PUBLICATIONS

International Search Report for PCT application No. PCT/EP2022/077370, mailed Jan. 18, 2023.

* cited by examiner

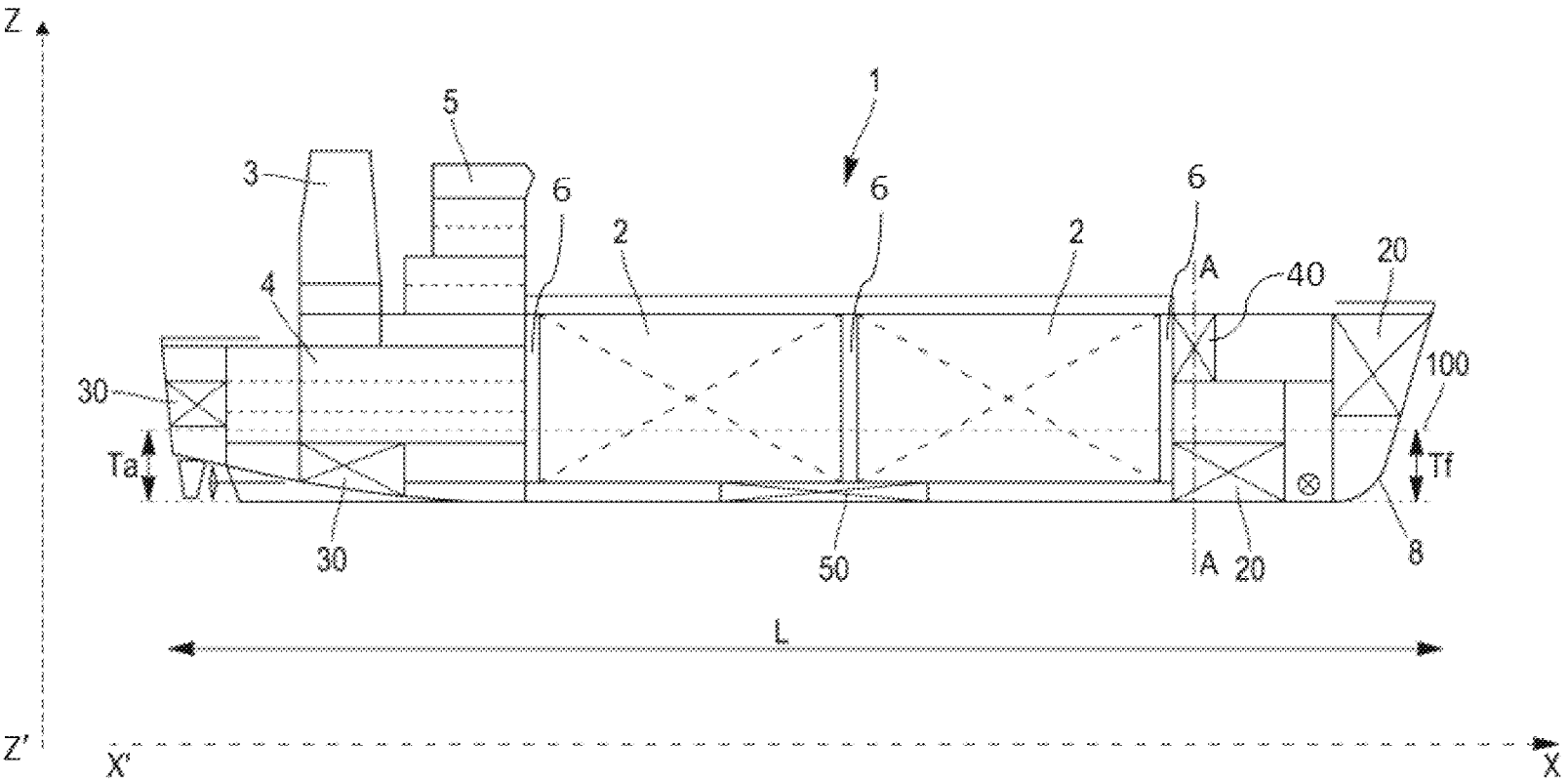
[Fig. 1A]

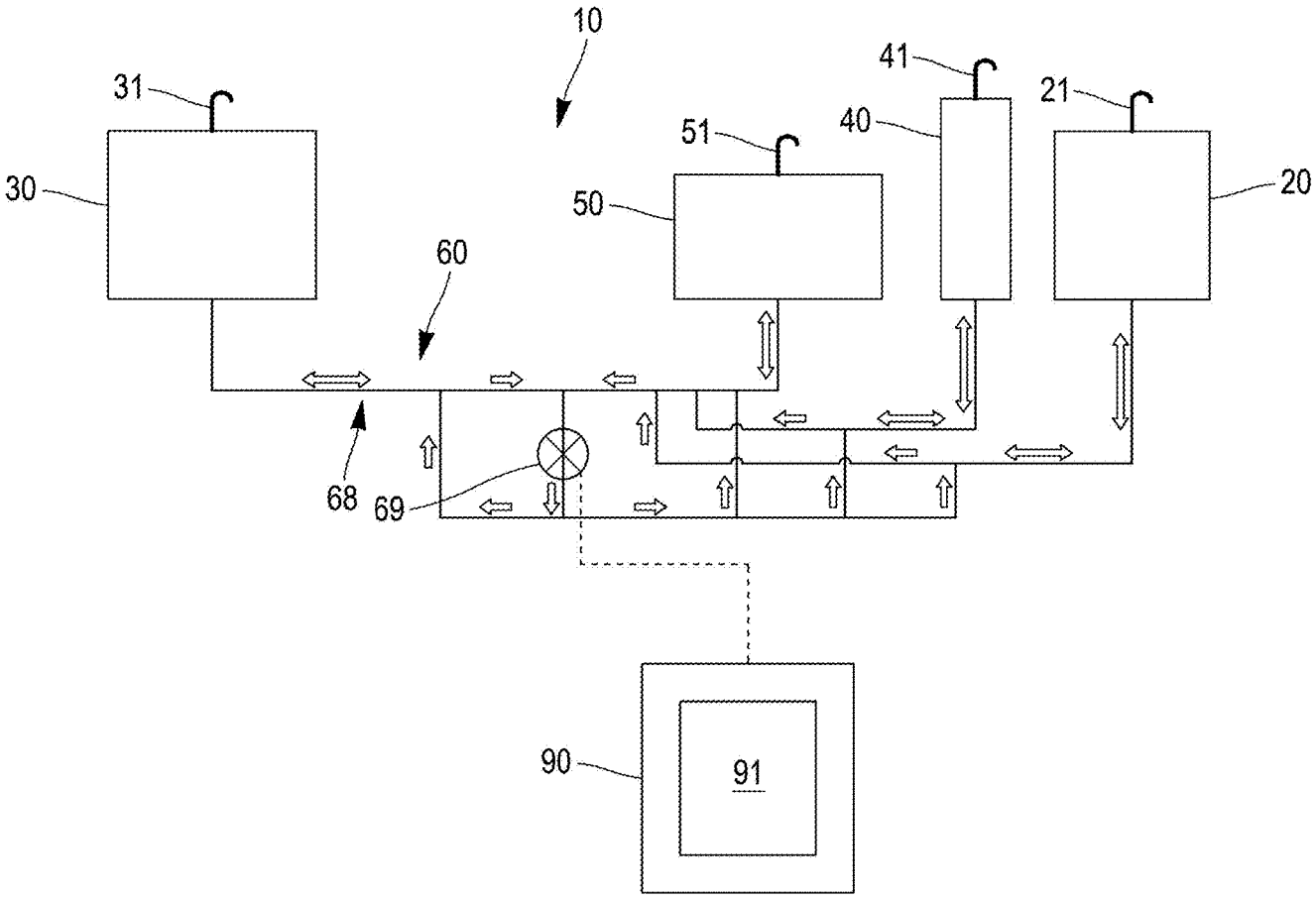
[Fig. 1B]

[Fig. 2A]
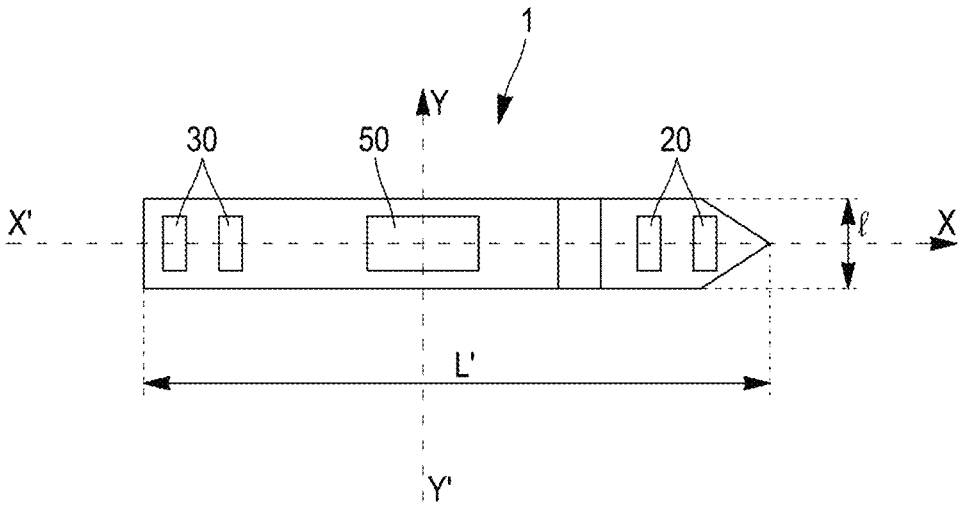
[Fig. 2B]
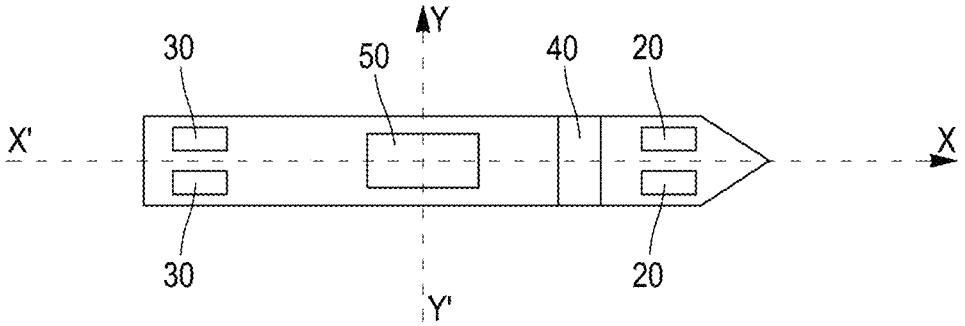

[Fig. 3A]
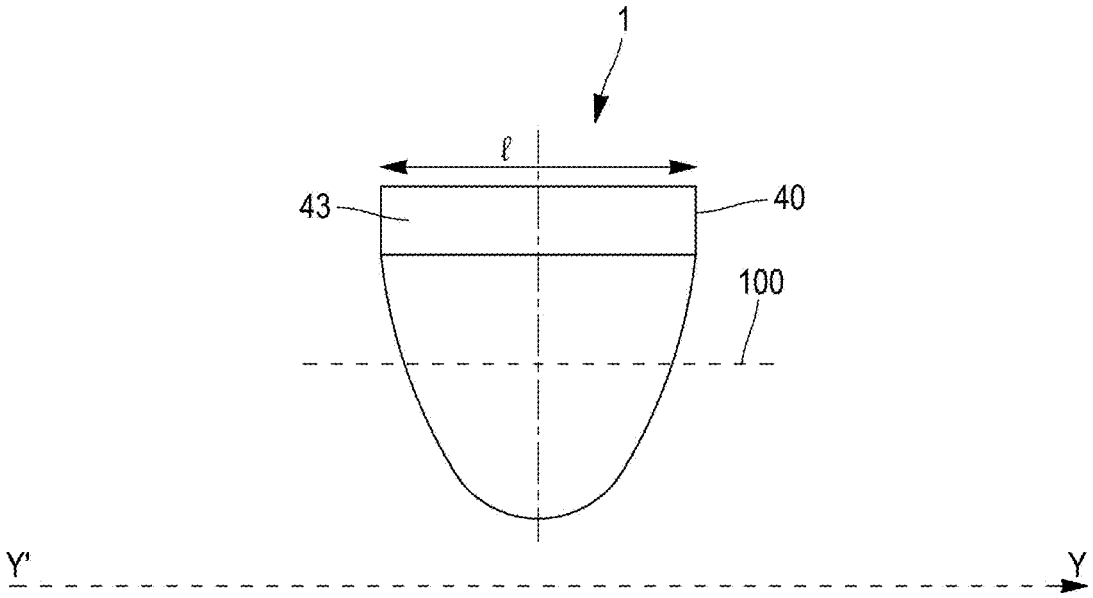
[Fig. 3B]
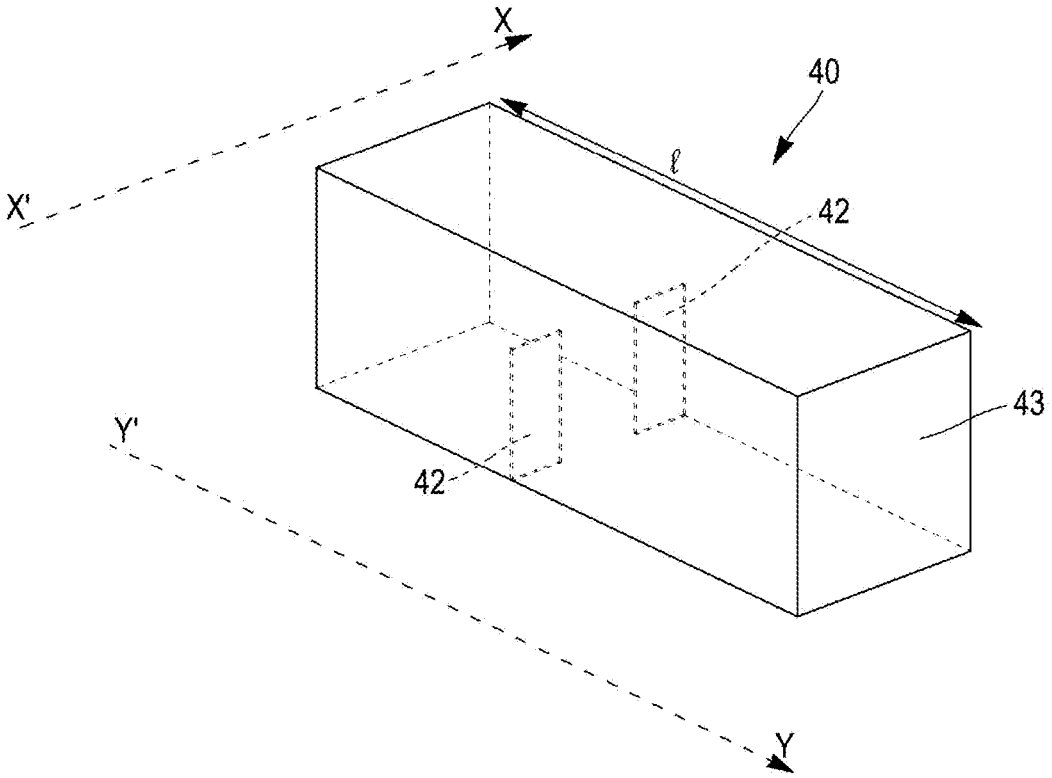

[Fig. 4]
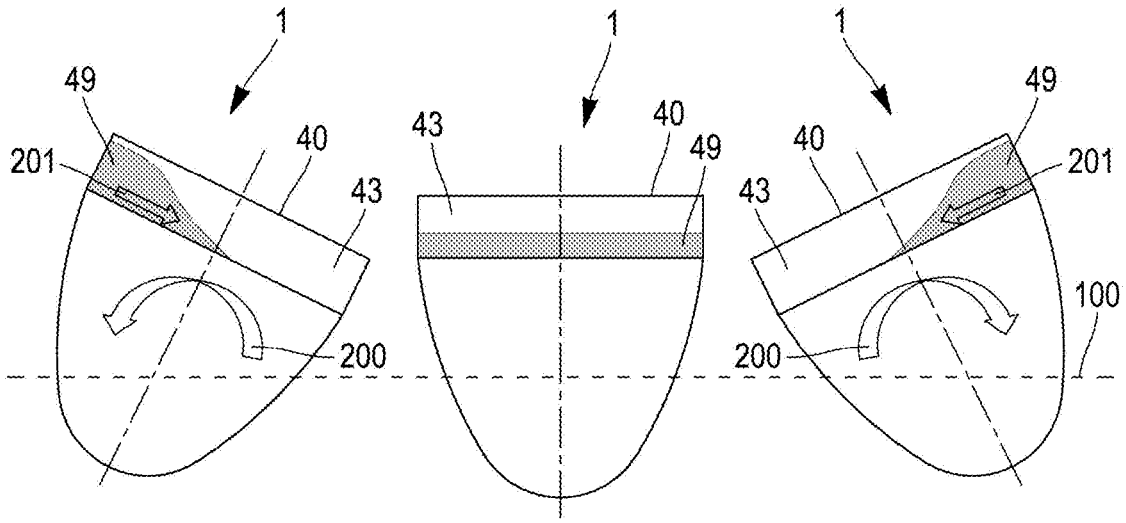

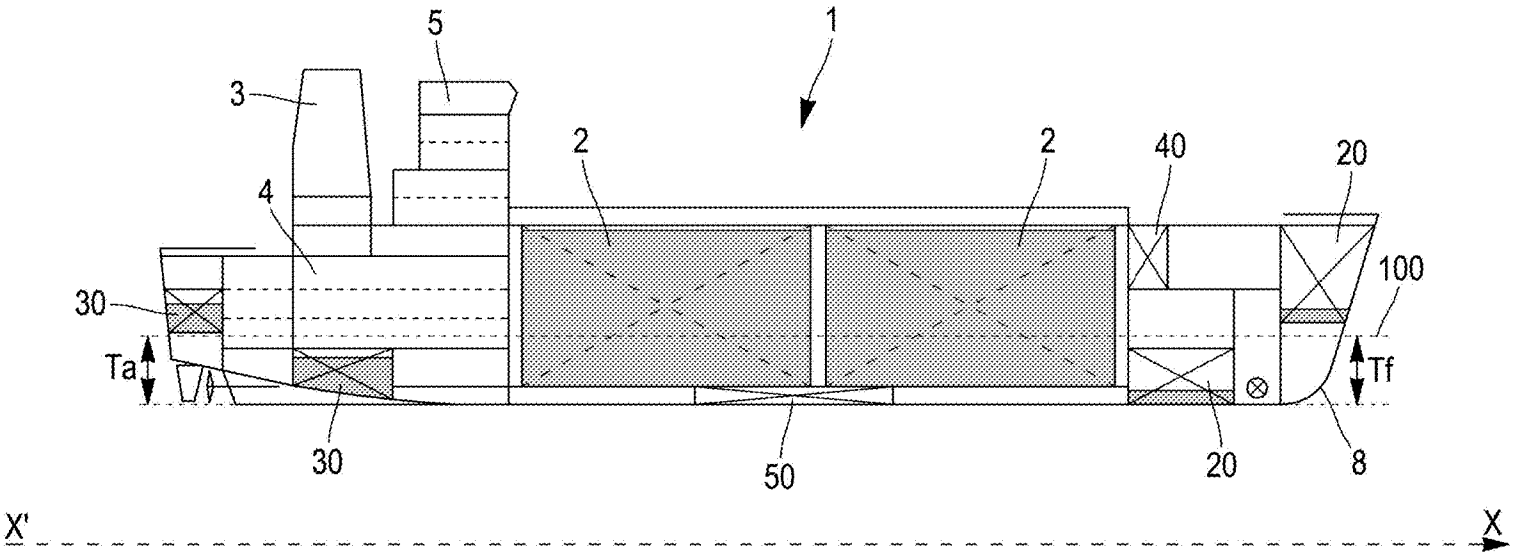
[Fig. 5A]

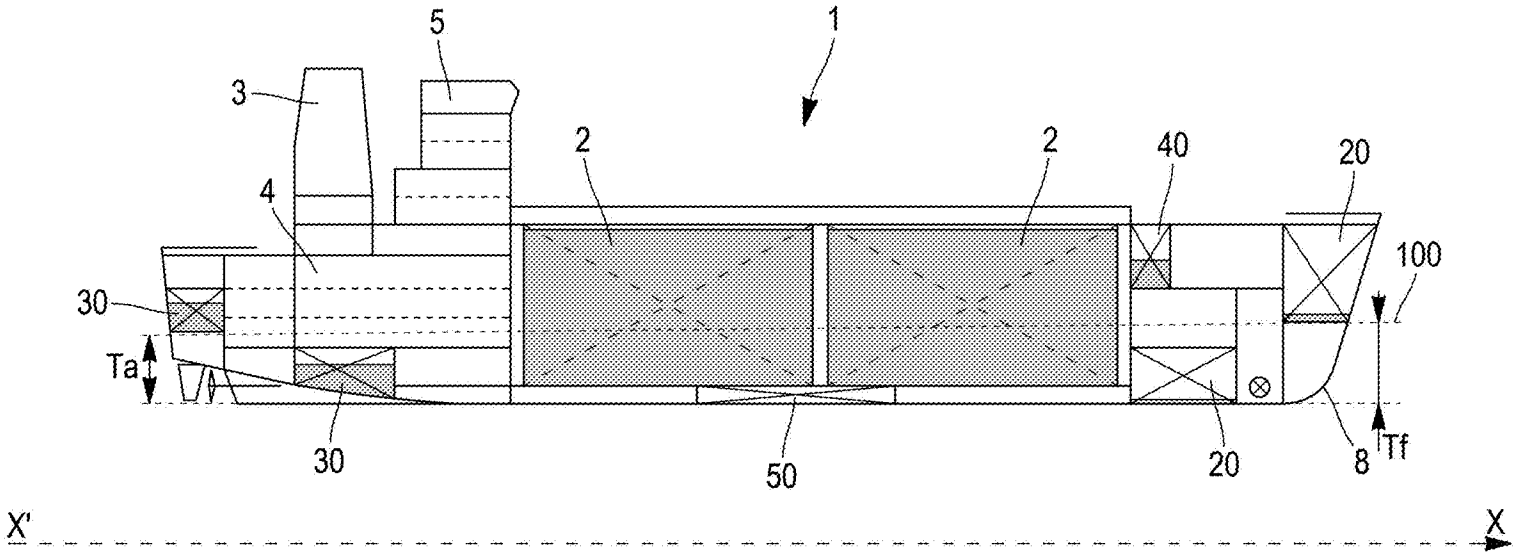
[Fig. 5B]

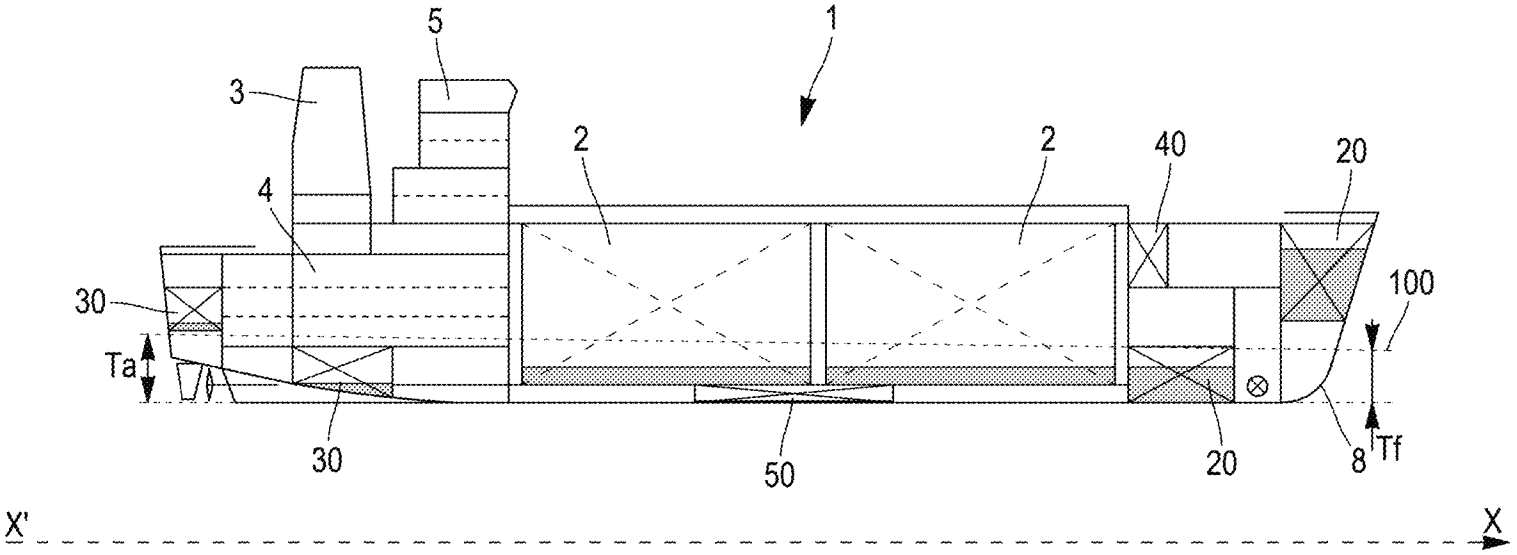
[Fig. 6A]

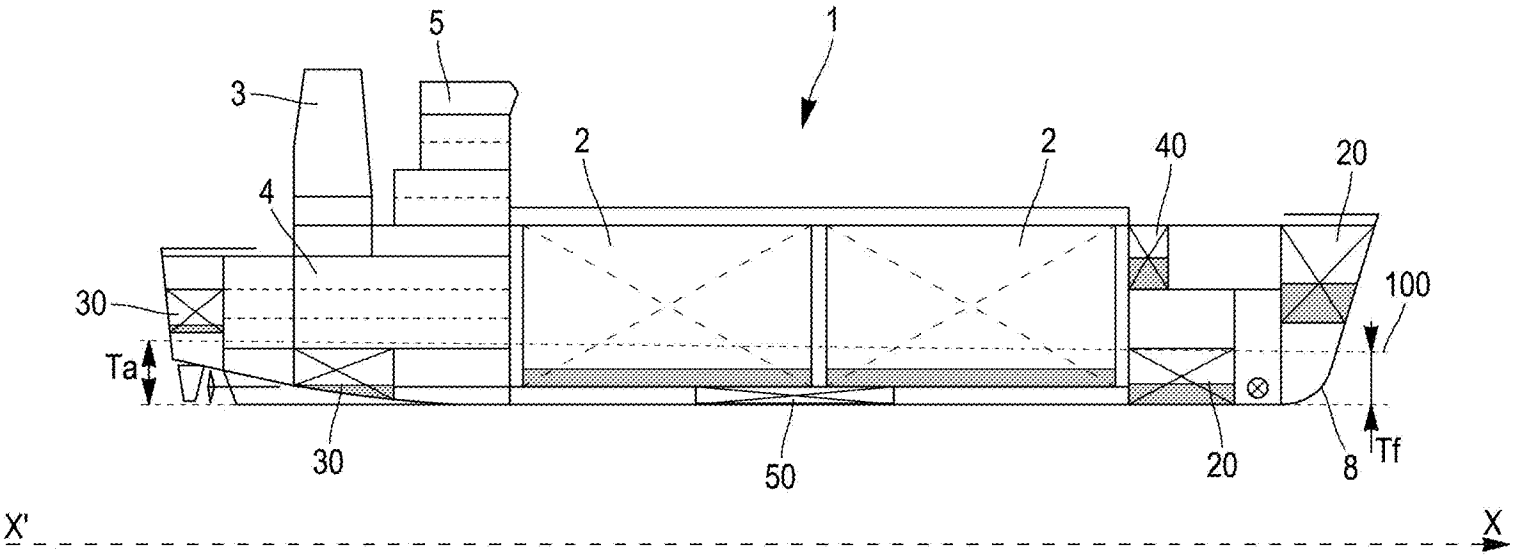
[Fig. 6B]

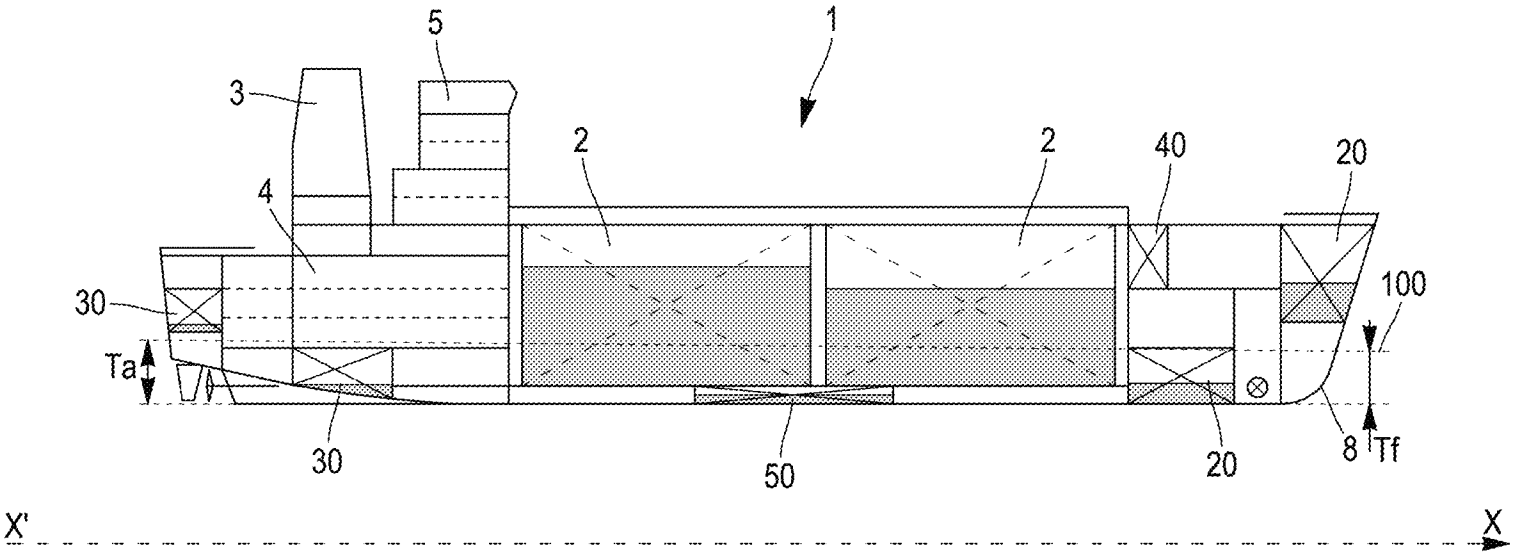
[Fig. 7A]

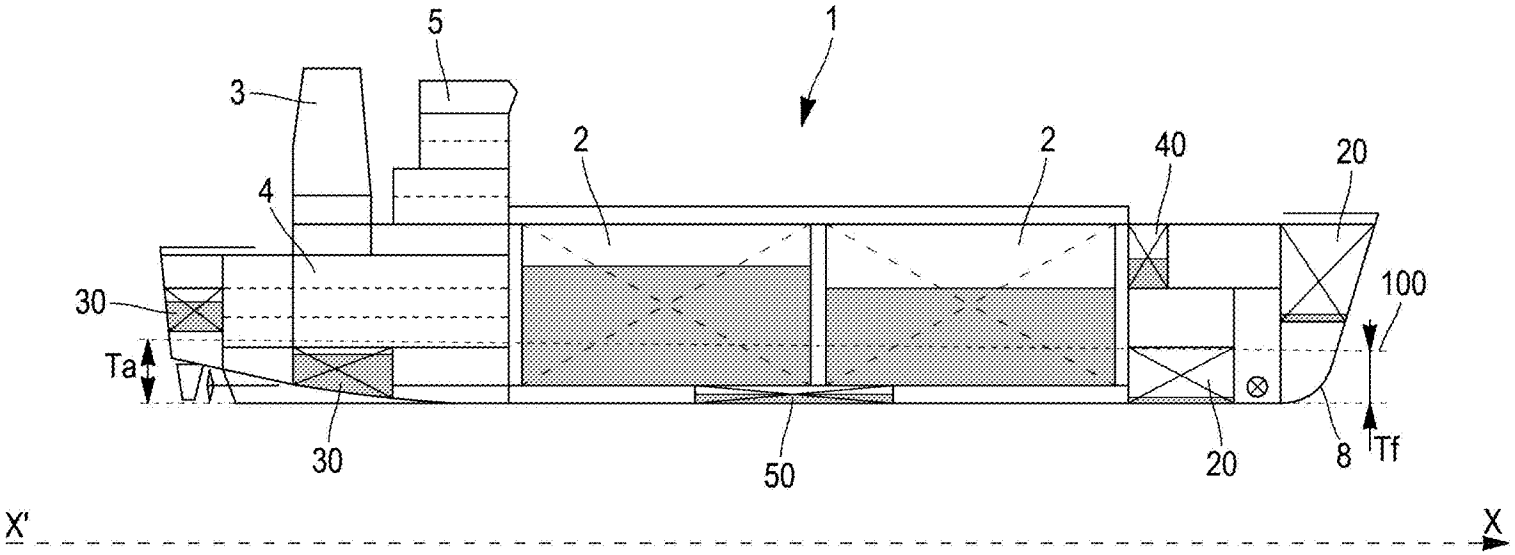
[Fig. 7B]

TRANSPORT SHIP COMPRISING A TRIM CONTROL SYSTEM WHICH IS NOT IN COMMUNICATION WITH THE SEA

TECHNICAL FIELD

The invention relates to a transport ship comprising a trim control system, and more specifically a transport ship comprising a trim control system not in communication with the sea.

PRIOR ART

Known goods transport ships are provided with seawater ballasts that can be filled or partially filled with seawater.

Typically, when the ship is carrying little or no load, the seawater ballasts are filled in order to lower the ship in the water, in other words to increase its draft or to raise the waterline of the ship. This ensures that the propulsion propeller or propellers are completely immersed, which prevents the propeller or propellers from lifting out of the water. This also prevents the draft at the bow of the ship from being too small, which may occur in a goods transport ship because the ship's equipment is often located at the rear of the ship.

A ship fitted with such seawater ballasts is described for example in document GB 2044201 A.

More recently, certain transport ships have also been fitted with roll-stabilizing tanks (RSTs), also known as anti-roll tanks (ARTs). Such a roll-stabilizing tank has a larger dimension along the transverse axis of the ship. It is intended to be partially filled with seawater. The flow of the seawater in the roll-stabilizing tank is slowed by one or more partition walls, thereby creating a momentum that tends to stabilize the rolling of the ship.

As mentioned above, the ballasts and the roll-stabilizing tank are filled with seawater. Typically, the ship takes on seawater when leaving its port of departure, and dumps this seawater upon arrival at its port of destination. By doing so, the ship transports aquatic organisms from one geographical zone to another, which entails risks for the ecosystems of seaports. For this reason, regulations increasingly tend to require decontamination or sterilization of the ballast water before dumping. Equipment for this purpose is available, but has the drawback of being expensive.

Furthermore, sediment tends to accumulate at the bottom of the seawater ballasts, which requires periodic maintenance of these ballasts.

SUMMARY OF THE INVENTION

One idea at the heart of the invention involves proposing a trim control system for a transport ship, said system overcoming the drawbacks related to seawater ballasts. Another idea at the heart of the invention involves enabling this trim control system to activate or deactivate roll stabilization of the ship at will.

The invention therefore proposes a transport ship comprising a trim control system not in communication with the sea, the ship having an empty weight $P_v$ of between 20% and 80%, preferably between 30% and 60%, of its total weight $P_T$, and having a maximum load weight capacity $P_{TC}$, calculated according to the following formula: $P_T=P_v+P_{TC}$, in which the trim control system comprises:

at least one front liquid tank, said at least one front liquid tank being located in a first third, preferably in a first quarter, along a longitudinal axis of the ship, at least one rear liquid tank, said at least one rear liquid tank being located in a final third, preferably in a final quarter, along the longitudinal axis of the ship, a roll-stabilizing tank, the roll-stabilizing tank having a larger dimension along a transverse axis of the ship, which may for example be between 60% and 100% of a width l of the ship along said transverse axis, and having at least one partition wall arranged to slow a flow of liquid in the roll-stabilizing tank along the transverse axis of the ship, and a distribution device, the distribution device being in communication with said at least one front liquid tank, said at least one rear liquid tank, and said roll-stabilizing tank, and being designed to distribute a volume of liquid therebetween, the distribution device including at least one pump and a plurality of valves.

Since the control system is not in communication with the sea, the ship neither takes on nor dumps seawater during its trip, which obviates all of the aforementioned drawbacks relating to seawater ballasts. Instead of this, the ship carries a volume of liquid, for example a constant volume, that is not intended to be dumped in the sea. The distribution device enables this volume of liquid to be distributed between the front liquid tank or tanks, the rear liquid tank or tanks, and the roll-stabilizing tank. Consequently, the distribution device enables the trim of the ship to be adjusted at will, these trim adjustments of the ship only being limited by the volume of liquid and by the respective filling volumes of the tanks. The distribution device also enables the roll stabilization of the ship to be activated or deactivated by the roll-stabilizing tank at will by partially filling this tank with liquid.

Depending on the embodiments, such a transport ship may have one or more of the following features.

According to one embodiment, the liquid is a liquid having a density of approximately 1, for example between 0.95 and 1.05. According to one specific embodiment, the liquid is fresh water.

According to one embodiment, the roll-stabilizing tank includes a pair of partition walls, preferably facing one another, and more preferably parallel to the longitudinal axis of the ship.

The distribution device may in principle be actuated manually by the crew of the ship by closing or opening the appropriate valves or by activating or deactivating the at least one pump, as required.

However, it is preferable for actuation of the distribution device to be more or less automatic. Thus, according to one embodiment, the ship comprises a control unit configured to command the distribution device as a function of a program and/or commands received from a human-machine interface.

According to one embodiment, the control unit is configured, in response to a roll-stabilization command, to command the distribution device to transfer liquid to the roll-stabilizing tank until the roll-stabilizing tank is filled to between 25% and 75% of its maximum filling volume.

Thus, in response to a simple command, the control unit can be used to activate or deactivate the roll stabilization of the ship at will using the roll-stabilizing tank.

The roll-stabilization command may for example be entered manually by a member of the crew when said crew member notes that the sailing conditions risk causing excessive rolling of the ship.

According to one embodiment, the control unit is also configured to command the distribution device as a function of the weight of a load of the ship and of the maximum load weight capacity $P_{TC}$ of the ship.

The maximum load weight capacity $P_{TC}$ of the aforementioned ship is provided by the builder of the ship and can therefore be stored in memory in the control unit. The weight of the load of the aforementioned ship may be entered by a member of the crew, for example at the beginning of the trip of the ship.

According to one embodiment, the control unit is configured, in response to the roll-stabilization command and when the weight of the load of the ship is between $0.2*P_{TC}$ and $0.8*P_{TC}$, to command the distribution device to transfer liquid to the roll-stabilizing tank from the front liquid tank and/or the rear liquid tank, preferably from the front liquid tank and the rear liquid tank and/or without increasing the draft at the bow of the ship.

According to one embodiment, the control unit is configured, in response to the roll-stabilization command and when the weight of the load of the ship is less than or equal to $0.2*P_{TC}$, to command the distribution device to transfer liquid to the roll-stabilizing tank from at least the front liquid tank, preferably exclusively from the front liquid tank and/or without increasing the draft at the bow of the ship.

According to one embodiment, the control unit is configured, in response to the roll-stabilization command and when the weight of the load of the ship is equal to or greater than $0.8*P_{TC}$, to command the distribution device to transfer liquid to the roll-stabilizing tank from the front liquid tank and/or the rear liquid tank, preferably from the front liquid tank and the rear liquid tank.

According to one embodiment, the total weight $P_{RT}$ of the at least one front tank and of the at least one rear tank, when entirely filled with a liquid having a density of 1, represents between 2% and 8%, preferably between 3% and 6%, of the empty weight $P_v$ of the ship.

According to one embodiment, the total weight $P_{ART}$ of the roll-stabilizing tank when filled with a liquid having a density of 1 is between 1% and 4%, preferably between 2% and 4%, of the empty weight $P_v$ of the ship.

According to one embodiment, the trim control system further comprises a central liquid tank located in a zone between 40% and 60% of a length L of the ship along the longitudinal axis of the ship.

The central liquid tank may notably be used, when partially or fully filled with liquid, to compensate for the bending stresses in the central region of the hull of the ship along the longitudinal axis of the ship. This is beneficial for the service life of the ship.

According to a preferred embodiment, the roll-stabilizing tank is located in the first third, preferably in the first quarter, along a longitudinal axis of the ship. Other embodiments are nonetheless possible, notably as a function of the different installations and fittings of the ship.

According to one embodiment, the distribution device is configured to transfer liquid from said at least one rear liquid tank to the roll-stabilizing tank via said central liquid tank.

According to one embodiment, the trim control system comprises at least two front liquid tanks spaced apart from one another and each located in the first third, preferably in the first quarter, along a longitudinal axis of the ship.

According to one embodiment, two of said front liquid tanks are spaced apart along the longitudinal axis of the ship.

According to one embodiment, the trim control system comprises at least two rear liquid tanks spaced apart from one another and each located in the final third, preferably in the final quarter, along the longitudinal axis of the ship.

According to one embodiment, two of said rear liquid tanks are spaced apart along the longitudinal axis of the ship.

According to one embodiment, the ship further comprises at least one sealed and thermally insulating tank.

According to one embodiment, the tank includes at least one sealing barrier and at least one thermally insulating barrier.

According to one embodiment, the tank includes a main structure comprising a multi-layer structure including, from the outside toward the inside, a secondary thermally insulating barrier including insulating elements and bearing against the load-bearing structure, a secondary sealing membrane bearing against the secondary thermally insulating barrier, a primary thermally insulating barrier including insulating elements and bearing against the secondary sealing membrane, and a primary sealing membrane that is designed to be in contact with the liquefied gas contained in the tank. According to another embodiment, a single thermally insulating barrier is arranged between a sealing membrane and the load-bearing structure.

According to one embodiment, at least a part of the space surrounding the tank is an open space. "Open space" means that the volume between two contiguous tanks or between the tank and another part of the ship (the spaces being known to the person skilled in the art as cofferdams) are open and not closed spaces, for example enabling the flow of ambient air to or from said volumes and the adjacent volumes.

According to one embodiment, the roll-stabilizing tank is adjacent to said open space.

According to one embodiment, the roll-stabilizing tank is located in front of the tank along the longitudinal axis of the ship.

According to one embodiment, the tank contains a cold liquid product, in particular liquefied natural gas (LNG) or a liquefied gas.

According to one embodiment, the roll-stabilizing tank is located above the or a front liquid tank along a vertical axis of the ship, the vertical axis of the ship being perpendicular to the longitudinal axis and to the transverse axis of the ship.

According to one embodiment, the roll-stabilizing tank is located in the ship above a waterline of the ship for all load weights equal to or less than the maximum load weight capacity $P_{TC}$ of the ship.

BRIEF DESCRIPTION OF THE FIGURES

The invention will be better understood, and additional objectives, details, features and advantages thereof will be set out more clearly, in the description below of several specific embodiments of the invention given solely as non-limiting examples, with reference to the drawings attached.

FIG. 1A is a schematic cross-section view along the longitudinal axis of the ship of a transport ship comprising a trim control system.

FIG. 1B is a functional diagram of a trim control system built into the transport ship in FIG. 1A.

FIG. 2A is a schematic top view of the ship showing a possible position of the liquid tanks of the trim control system in FIG. 1B.

FIG. 2B is a view similar to FIG. 2A showing another possible position of the liquid tanks of the trim control system in FIG. 1B.

FIG. 3A is a schematic view of the transport ship in FIG. 1A along A-A.

FIG. 3B is a perspective transparent view of the roll-stabilizing tank shown in cross section in FIG. 3A.

FIG. 4 is a schematic diagram showing operation of the roll-stabilizing tank shown in FIG. 3A and FIG. 3B.

FIG. 5A is a view similar to FIG. 1A showing the ship in a configuration in which the ship is heavily loaded and in which the roll-stabilizing tank is not in use.

FIG. 5B is a view approximately identical to FIG. 5A, but in which the roll-stabilizing tank is in use.

FIG. 6A is a view similar to FIG. 1A showing the ship in a configuration in which the ship is lightly loaded and in which the roll-stabilizing tank is not in use.

FIG. 6B is a view approximately identical to FIG. 6A, but in which the roll-stabilizing tank is in use.

FIG. 7A is a view similar to FIG. 1A showing the ship in a configuration in which the ship is moderately loaded and in which the roll-stabilizing tank is not in use.

FIG. 7B is a view approximately identical to FIG. 7A, but in which the roll-stabilizing tank is in use.

DESCRIPTION OF THE EMBODIMENTS

FIG. 1A is a schematic view of a goods transport ship 1 (hereinafter "the ship 1") in cross section along the longitudinal axis X-X' of the ship 1. The direction X' toward X is the direction of movement of the ship 1 when sailing.

The ship 1 is in this case a transport ship for a liquefied gas, specifically liquefied natural gas (LNG). Accordingly, the ship 1 includes one or more (in this case, two) tanks 2 that are sealed and thermally insulating. The tanks 2 are located in front, along the longitudinal axis X-X' of the ship 1, of a superstructure 5 provided with a bridge. The superstructure 5 is itself located in front of one or more funnels 3 arranged on top of an engine room 4 arranged beneath the superstructure 5 and beneath the funnel or funnels 3. It is nonetheless specified that the ship 1 may more generally be a transport ship for another liquid product, or even a transport ship for any other type of goods. Also in this case, the tank or the transport holds of the ship 1 are located in front of the superstructure 5.

Each tank 2 may be a tank comprising a sealing barrier and a thermally insulating barrier, notably an independent type A, B or C tank according to the International Maritime Organisation (IMO) code or any equivalent tank. Alternatively, each tank 2 may include a main structure comprising a multi-layer structure including, from the outside toward the inside, a secondary thermally insulating barrier including insulating elements and bearing against the load-bearing structure, a secondary sealing membrane bearing against the secondary thermally insulating barrier, a primary thermally insulating barrier including insulating elements and bearing against the secondary sealing membrane, and a primary sealing membrane that is designed to be in contact with the liquefied gas contained in the tank. Preferably, the load-bearing structure is constituted by at least some of the walls of the ship 1. According to another alternative, a single thermally insulating barrier is arranged between a sealing membrane and the load-bearing structure. These tanks may for example be made using the applicant's Mark III® or NO96® technologies. The tanks 2 are preferably surrounded at least in part by cofferdams 6 (see FIG. 1A).

The ship 1 further comprises a trim control system 10 that will be described in detail below with reference to FIGS. 1A and 1B. It is stated that in FIG. 1A, the liquid tanks of the trim control system 10 and the tanks 2 are shown empty, the filling options of the liquid tanks of the trim control system and of the tanks 2 being described further below.

The trim control system 10 is not in communication with the sea, and comprises at least one front tank 20, at least one rear tank 30, a roll-stabilizing tank 40, and optionally a central tank 50.

In the example shown in FIG. 1A and FIG. 2A, two front tanks 20 are provided. The front tanks 20 are both located in a first quarter of the ship 1 along the longitudinal axis X-X' of the ship 1. "First quarter" means the zone located between 0% and 25% of the length L of the ship 1 along the axis X-X', taking 0% to be the bow of the ship and moving toward the stern of the ship. In a variant, the two front tanks 20 may be located in a first third of the ship, where "first third" refers to the zone located between 0% and 33.3% of the length of the ship 1 along the axis X-X'.

Still with reference to FIG. 1A and FIG. 2A, two rear tanks 30 are provided, both located in a final quarter of the ship along the longitudinal axis X-X' of the ship 1. "Final quarter" means the zone located between 75% and 100% of the length L of the ship 1 along the axis X-X'. In a variant, the two rear tanks 30 may be located in a final third of the ship, where "final third" refers to the zone located between 66.7% and 100% of the length of the ship 1 along the axis X-X'.

The central tank 50 is for its part located in a zone between 40% and 60% of the length L of the ship 1 along the axis X-X'. The central tank 50 is typically centered on the axis X-X'.

FIGS. 1A and 2A show that the two front tanks 20 and the two rear tanks 30 are spaced apart from one another along the axis X-X' of the ship 1. However, in a variant and as shown in FIG. 2B, two front tanks 20 and two rear tanks 30 may be spaced apart from one another in a direction parallel to the transverse axis Y-Y' of the ship 1. Many other configurations are possible. Notably, the number of front tanks 20 and rear tanks 30 shown are merely an example. A single front tank 20 or three or more front tanks 20 may be provided, and independently a single rear tank 30 or three or more rear tanks 30 may be provided, spaced apart from one another along the axis X-X' and/or the axis Y-Y'.

The roll-stabilizing tank 40 will now be described. The roll-stabilizing tank 40 is located in the first third, preferably in the first quarter, along the axis X-X' of the ship 1. The roll-stabilizing tank 40 is thus located in front, along the axis X-X', of the tanks 2 and where applicable of the cofferdams 6. For example and as shown in the figures, the roll-stabilizing tank 40 may be adjacent to the frontmost cofferdam 6 along the axis X-X'. As shown in the figures and more specifically in FIGS. 2A, 2B and 3A, the roll-stabilizing tank 40 has a largest dimension along the transverse axis Y-Y' of the ship 1. In the example shown, this largest dimension is equal to the greatest width l of the ship 1 along the transverse axis Y-Y'. However, in a variant, this largest dimension may be between 60% and 100% of l. As shown in the figures and notably in FIG. 1A, in which Z-Z' is a vertical axis perpendicular to the axis X-X' and to the axis Y-Y', the roll-stabilizing tank 40 may be above one of the front tanks 20 along the axis Z-Z'.

FIG. 3B is a perspective transparent view of the roll-stabilizing tank 40. As shown in this figure, the roll-stabilizing tank 40 is provided with a pair of partition walls 42. The partition walls 42 are arranged in the internal volume 43 of the roll-stabilizing tank 40, preferably facing one another, in this case parallel to the axis X-X'. In this case, the partition walls 42 only extend over a part of the height of the internal volume 43, but could extend over the entire height of the internal volume 43. Furthermore, a greater number of partition walls 42 may be provided, or a single partition wall 42 may be provided. The geometry of the partition walls 42 is intended to enable the flow of liquid in the internal volume 43 to be controlled.

In any case, the partition walls 42 are arranged to slow a flow of liquid in the roll-stabilizing tank along the axis Y-Y', without thereby completely preventing this flow of liquid. The liquid therefore remains free to move in the internal volume 43 despite the presence of the partition walls 42.

The role of the partition walls 42 when the roll-stabilizing tank 40 is partially filled with liquid will now be described with reference to FIG. 4.

The different views in FIG. 4 show the ship 1 subjected to a rolling motion 200, this rolling motion 200 having a given frequency, while the roll-stabilizing tank 40 is filled with a given volume 49 of liquid.

The left-hand view in FIG. 4 shows the ship 1 near to its maximum angle of heel as a result of the rolling motion 200. Since the partition walls 42 tend to slow the movement of the liquid in the internal volume 43, said walls retain the liquid so that the majority of the volume 49 of liquid is still on the side opposite the side to which the ship 1 is heeling. The liquid then generates a moment that tends to stabilize the ship 1. However, the liquid starts to move toward the other side of the internal volume 43, firstly as a result of the force of gravity generated by the initial inclination, and subsequently as a result of the inertia of the liquid. This displacement of the liquid is represented by the arrow 201.

Then, when the ship 1 reaches near to its maximum angle of heel on the other side, as shown in the right-hand view in FIG. 4, most of the liquid is again on the side opposite the side to which the ship 1 is heeling, and again generates a moment that tends to stabilize the ship 1.

Since the rolling motion 200 has a given frequency, the configurations shown in the left-hand view and the right-hand view in FIG. 4 occur alternately at that frequency, and each time the liquid generates a moment that tends to stabilize the ship 1. This demonstrates that partially filling the internal volume 43 with liquid attenuates the effect of the rolling motion 200 on the ship.

This operating principle is known as such, and roll-stabilizing tanks operating on this principle are marketed notably by the company Hoppe Marine GmbH under the registered trademark FLUME® and by the company GEPS Techno SAS under the registered trademark SIRE®. The design of the adapted partition walls 42 is therefore a common task when balancing and controlling trim in ships.

The time it takes the liquid to flow in the internal volume 43 depends mainly on the structure of the partition walls 42, and to a lesser extent on the volume 49 of liquid in the roll-stabilizing tank 40. As mentioned above, the design of the adapted partition walls 42 is a common task when balancing and controlling trim in ships, and as such the person skilled in the art is able to adapt the partition walls 42 to obtain the desired roll-stabilizing effect.

When in use as described above, the roll-stabilizing tank 40 is typically filled with a volume 49 of liquid of between 25% and 75% of the maximum filling volume of the roll-stabilizing tank 40. The person skilled in the art is able to adjust the volume 49 of liquid within this range as a function of circumstances and notably as a function of the weight of the load of the ship 1, in order to obtain the desired roll-stabilizing effect. Again, this task is a common task when balancing and controlling trim in ships.

The combined use of the roll-stabilizing tank 40 and of the tanks 20, 30 and 50 to control the trim of the ship is described below.

Returning to FIG. 1B, in order to command these different tanks to be filled, the trim control system 10 comprises a liquid distribution device 60 (hereinafter "the distribution device 60"). The distribution device 60 enables a volume of liquid to be distributed between these different tanks. This volume of liquid is for example constant, where the distribution device 60 is not designed to receive additional liquid or to discharge the liquid as the ship 1 is sailing. In other words, the distribution device 60 commands how the volume of liquid, optionally a constant volume, is distributed between the tanks 20, 30 and 50 and the roll-stabilizing tank 40. Furthermore and as mentioned above, the trim control system 10 is not in communication with the sea. The liquid distributed by the distribution device 60 is therefore not seawater that the ship 1 takes on when leaving its port of departure and dumps upon arrival at its port of destination, as is the case with conventional seawater ballasts.

The filling of the different tanks using the distribution device 60 may for example be modified during maintenance operations on the ship, for example to top up the tanks following losses or to completely empty the tanks and refill them, etc.

The liquid contained in the tanks and distributed by the distribution device 60 is typically freshwater. Freshwater is available from a very large number of infrastructures, and further simplifies the design and maintenance of the trim control system 10. The remainder of the present description refers to the scenario in which freshwater is used in the trim control system 10. Other liquids may nonetheless be used. It is preferable for the density of the liquid to be approximately 1, for example between 0.95 and 1.05, in order to simplify the design and use of the trim control system 10.

To distribute the water between the tanks 20, 30, 40 and 50, the distribution device 60 comprises a set 68 of ducts bringing these different tanks into communication, and at least one pump 69 enabling the water to be moved between these different tanks. The hollow arrows in FIG. 1B show an example of flow direction of the water in the set 68 of ducts. Furthermore, but not shown in FIG. 1B, the distribution device 60 comprises a set of valves for controlling the ingress or otherwise of water into each of the tanks 20, 30, 40 and 50, as well as the filling rate of each of these tanks. The tanks 20, 30, 40 and 50 are respectively provided with pressure balancing orifices 21, 31, 41, 51 that bring the internal volume of these tanks into communication with the ambient air, thereby enabling the water contained in these tanks to be drained.

The trim control system 10 also comprises a control unit 90. As shown with a broken line in FIG. 1B, the control unit 90 is configured to control the distribution device 60, and more specifically to control the at least one pump 69 and each of the valves (not shown) already mentioned above.

The control unit 90 may be implemented using any combination of suitable hardware and/or software. The control unit 90 is typically carried on board the ship 1, and may be in communication with other equipment carried on board the ship 1. The control unit 90 may comprise or be in communication with a user interface device 91 enabling a member of the crew to enter the commands to control operation of the control unit 90, and therefore of the distribution device 60 and of the trim control system 10. Notably, a member of the crew may enter a weight of a load of the ship 1 into the control unit 90 using the user interface device 91, for example at the start of the trip of the ship 1, as well as a maximum load weight capacity $P_{TC}$ of the ship 1. In a variant, the maximum load weight capacity $P_{TC}$ of the ship 1 can be stored in memory in the control unit 90. Alternatively, the weight of the load of the ship 1 may be provided to the control unit 90 by another device, carried on board the ship 1 or otherwise.

The maximum load weight capacity $P_{TC}$ of the ship 1 is provided by the builder of the ship 1. In this case, the ship 1 has an empty weight $P_v$ of between 20% and 80%, preferably between 30% and 60%, of its total weight $P_T$, so that $P_v$, $P_T$ and $P_{TC}$ are related by the following formula: $P_T=P_v+P_{TC}$. It is stated that the empty weight $P_v$ of the ship is provided by the builder of the ship 1, and specifies the weight of the ship 1 with no cargo and no other device other than the devices required for operation of the ship and optionally a negligible quantity of fuel.

According to one embodiment, the total weight $P_{RT}$ of the front tanks 20 and of the rear tanks 30, when entirely filled with a liquid having a density of 1, represents between 2% and 8%, preferably between 3% and 6%, of the empty weight $P_v$ of the ship 1.

According to one embodiment, the total weight $P_{ART}$ of the roll-stabilizing tank 40 when filled with a liquid having a density of 1 represents between 1% and 4%, preferably between 2% and 4%, of the empty weight $P_v$ of the ship.

With reference to FIGS. 5A to 7B, the different commands executed by the control unit 90 will now be described below as a function of the weight of the load of the ship 1 in relation to the maximum load weight capacity $P_{TC}$.

FIGS. 5A and 5B show a first example in which the weight of the load of the ship 1 is very close to the maximum load weight capacity $P_{TC}$. Specifically, the filling level of the tanks 2 is very close to the maximum authorized filling level of the tanks 2.

In FIG. 5A, the roll-stabilizing tank 40 is not filled with water and is therefore not operational. The volume of water contained in the trim control system 10 is therefore distributed between the front tanks 20, the rear tanks 30 and the central tank 50. In the example shown, the volume of water is distributed between these tanks so that the draft at the bow of the ship 1, hereinafter denoted Tf, is equal to or substantially equal to the draft at the stern of the ship 1, hereinafter denoted Ta. The drafts Ta and Tf are measured, as is well-known in the domain of shipping, from the waterline of the ship or in relation to the surface of the sea, which is indicated with reference sign 100 in the drawings.

In FIG. 5B, the roll-stabilizing tank 40 is partially filled with water, and more specifically between 25% and 75% of its maximum filling volume, as mentioned above.

The control unit 90 can command the distribution device 60 to switch from the distribution of the volume of water shown in FIG. 5A to the distribution of the volume of water shown in FIG. 5B. More specifically, in response to a roll-stabilization command, the control unit 90 commands the distribution device 60 to transfer water to the roll-stabilizing tank 40 until said tank is partially filled with water, as mentioned above. The roll-stabilization command may for example be provided to the control unit 60 by a member of the crew. In principle, to fill the roll-stabilizing tank 40, the distribution device 60 may draw water exclusively from the rear tanks 30, exclusively from the front tanks 20, or exclusively from the central tank 50. However, it is preferable for the distribution device 60 to draw water simultaneously from the rear tanks 30 and from the front tanks 20, or simultaneously from the rear tanks 30 and the front tanks 20 and the central tank 50, so as not to excessively modify the trim of the ship 1. However, as shown in FIG. 5B, it is acceptable to slightly increase the draft at the bow of the ship 1 Tf.

It should be noted that the control described above in relation to FIGS. 5A and 5B may be executed when the weight of the load of the ship 1 is equal to or greater than $0.8*P_{TC}$. More specifically, the control unit 90 obtains the weight of the load of the ship 1 and obtains the maximum load weight capacity $P_{TC}$ as described above, then commands the distribution device 60 as described above when the weight of the load of the ship 1 is equal to or greater than $0.8*P_{TC}$.

FIGS. 6A and 6B show a second example in which the weight of the load of the ship 1 is small compared to $P_{TC}$. Specifically, the filling level of the tanks 2 is low. This situation may notably occur when the ship 1 is transporting LNG in the tanks 2. In such a situation, a minimum level of LNG must be left in the tanks 2, referred to as "liquid heel", as is known. As can be seen by comparing FIG. 6A with FIG. 5A, the front tanks 20 are filled with more water in the configuration in FIG. 6A than in the configuration in FIG. 5A in order to counterbalance the weight of the equipment located at the rear of the ship 1, notably the engine room 4, the funnel or funnels 3 and the superstructure 5 thereof, and to prevent the draft at the bow of the ship 1 Tf from being too small.

In FIG. 6B, the roll-stabilizing tank 40 is partially filled with water, and more specifically between 25% and 75% of its maximum filling volume, as mentioned above.

The control unit 90 can command the distribution device 60 to switch from the distribution of the volume of water shown in FIG. 6A to the distribution of the volume of water shown in FIG. 6B. More specifically, in response to the roll-stabilization command, the control unit 90 commands the distribution device 60 to transfer water to the roll-stabilizing tank 40 until said tank is partially filled with water, as mentioned above. In principle, to fill the roll-stabilizing tank 40, the distribution device 60 can draw water simultaneously from the rear tanks 30 and from the front tanks 20, or simultaneously from the rear tanks 30 and the front tanks 20 and the central tank 50. However, it is preferable for the distribution device 60 to draw water exclusively from the front tanks 20 to prevent transferring even more water toward the front of the ship 1, thereby preventing the draft at the bow of the ship 1 Tf from increasing. This is because it is preferable not to increase Tf so as not to excessively lower the bow 8 of the ship 1 in the water, which could have a negative effect on the sailing properties of the ship 1.

It should be noted that the control described above in relation to FIGS. 6A and 6B may be executed when the weight of the load of the ship 1 is equal to or less than $0.2*P_{TC}$. More specifically, the control unit 90 obtains the weight of the load of the ship 1 and obtains $P_{TC}$ as described above, then commands the distribution device 60 as described above when the weight of the load of the ship 1 is equal to or less than $0.2*P_{TC}$.

FIGS. 7A and 7B show a third example in which the weight of the load of the ship 1 is in between those shown in FIGS. 5A-5B and 6A-6B. This situation can notably occur when the tanks 2 are partially filled with LNG or any other liquid product.

In FIG. 7B, the roll-stabilizing tank 40 is partially filled with water, and more specifically between 25% and 75% of its maximum filling volume, as mentioned above.

The control unit 90 can command the distribution device 60 to switch from the distribution of the volume of water shown in FIG. 7A to the distribution of the volume of water shown in FIG. 7B. More specifically, in response to the roll-stabilization command, the control unit 90 commands the distribution device 60 to transfer water to the roll-stabilizing tank 40 until said tank is partially filled with water, as mentioned above. In principle, to fill the roll-stabilizing tank 40, the distribution device 60 may draw water exclusively from the rear tanks 30, exclusively from the front tanks 20, or exclusively from the central tank 50. However, it is preferable for the distribution device 60 to draw water simultaneously from the rear tanks 30 and from the front tanks 20, or simultaneously from the rear tanks 30 and the front tanks 20 and the central tank 50, so as not to adjust the trim of the ship 1 or at least not to increase the draft at the bow of the ship 1 Tf.

It should be noted that the control described above in relation to FIGS. 7A and 7B may be executed when the weight of the load of the ship 1 is between $0.2*P_{TC}$ and $0.8*P_{TC}$, excluding these lower and upper limits. More specifically, the control unit 90 obtains the weight of the load of the ship 1 and obtains the maximum load weight capacity Pc as described above, then commands the distribution device 60 as described above when the weight of the load of the ship 1 is strictly between $0.2*P_{TC}$ and $0.8*P_{TC}$.

Although a command executed by the control unit 90 as a function of the weight of the load of the ship 1 and of the maximum load weight capacity $P_{TC}$ of the ship 1 has been described above, the control unit 90 may in a variant control the distribution device 60 independently of these magnitudes, for example exclusively as a function of a command from a member of the crew.

It will be noted that the roll-stabilizing tank 40 is located in the ship 1 above the waterline 100 of the ship, regardless of the weight of the load of the ship 1 (as long as this weight is less than or equal to $P_{TC}$).

Some of the elements shown, notably the control unit 90, may be provided in different forms, in a unitary or distributed manner, using hardware and/or software components. The usable hardware components include application-specific integrated circuits (ASICs), field-programmable gate arrays (FPGAs) and microprocessors. The software components may be written in different programming languages, for example C, C++, Java (registered trademark) or VHDL. This list is not exhaustive.

The control unit 90 may also be absent or less advanced. Thus, according to the embodiments, the crew may control the valves and/or pumps of the distribution device 60 directly or indirectly to implement the following uses:

- when the weight of the load of the ship 1 is between $0.2*P_{TC}$ and $0.8*P_{TC}$, to transfer liquid to the roll-stabilizing tank 40 from the front liquid tank 20 and/or the rear liquid tank 30, preferably from the front liquid tank 20 and the rear liquid tank 30 and/or without increasing the draft Tf at the bow of the ship 1.
- when the weight of the load of the ship is less than or equal to $0.2*P_{TC}$, to transfer liquid to the roll-stabilizing tank 40 from at least the front liquid tank 20, preferably exclusively from the front liquid tank 20 and/or without increasing the draft Tf at the bow of the ship 1.
- when the weight of the load of the ship is equal to or greater than $0.8*P_{TC}$, to transfer liquid to the roll-stabilizing tank 40 from the front liquid tank 20 and/or the rear liquid tank 30, preferably from the front liquid tank 20 and the rear liquid tank 30.

Furthermore, it should be noted that when the water is transferred from the rear tanks 30 to the roll-stabilizing tank 40, it may be preferable for this water to be transferred via the central tank 50.

Although the invention has been described in relation to several specific embodiments, it is evidently in no way limited thereto and it includes all of the technical equivalents of the means described and the combinations thereof where these fall within the scope of the invention.

Use of the verb "include", "comprise" or "have", including when conjugated, does not exclude the presence of other elements or other steps in addition to those mentioned in a claim.

In the claims, any reference sign between parentheses should not be understood as a limitation of the claim.

The invention claimed is:

1. A transport ship (1) comprising a trim control system (10) not in communication with a sea, the transport ship (1) having an empty weight $P_v$ of between 20% and 80% of a total weight $P_T$ thereof, and having a maximum load weight capacity ($P_{TC}$), calculated according to the following formula: $P_T=P_v+P_{TC}$, in which the trim control system (10) comprises:

- at least one front liquid tank (20), said at least one front liquid tank being located in a first third along a longitudinal axis (X-X') of the transport ship (1),
- at least one rear liquid tank (30), said at least one rear liquid tank being located in a final third along the longitudinal axis (X-X') of the transport ship (1),
- a roll-stabilizing tank (40), the roll-stabilizing tank (40) having a larger dimension along a transverse axis (Y-Y') of the transport ship (1), and having at least one partition wall (42) arranged to slow a flow of liquid in the roll-stabilizing tank (40) along the transverse axis (Y-Y') of the transport ship,
- a distribution device (60), the distribution device being in communication with said at least one front liquid tank (20), said at least one rear liquid tank (30), and said roll-stabilizing tank (40), and being configured to distribute a volume of a liquid therebetween, the distribution device including at least one pump (69) and a plurality of valves; and
- a central liquid tank (50) located in a zone between 40% and 60% of a length L of the transport ship (1) along the longitudinal axis (X-X') of the transport ship (1).

2. The transport ship (1) as claimed in claim 1, further comprising a control unit (90) configured, in response to a roll-stabilization command, to command the distribution device (60) to transfer liquid to the roll-stabilizing tank (40) until the roll-stabilizing tank is filled to between 25% and 75% of its maximum filling volume.

3. The transport ship (1) as claimed in claim 2, in which the control unit (90) is also configured to command the distribution device (60) as a function of a weight of a load of the transport ship (1) and of the maximum load weight capacity ($P_{TC}$) of the transport ship (1).

4. The transport ship (1) as claimed in claim 3, in which the control unit (90) is configured, in response to the roll-stabilization command and when the weight of the load of the transport ship (1) is between $0.2*P_{TC}$ and $0.8*P_{TC}$, to command the distribution device (60) to transfer the volume of the liquid to the roll-stabilizing tank (40) from the at least one front liquid tank (20) and/or the at least one rear liquid tank (30).

5. The transport ship (1) as claimed in claim 3, in which the control unit (90) is configured, in response to the roll-stabilization command and when the weight of the load of the transport ship (1) is less than or equal to $0.2*P_{TC}$, to command the distribution device (60) to transfer the volume of the liquid to the roll-stabilizing tank (40) from the at least the front liquid tank (20).

6. The transport ship (1) as claimed in claim 3, in which the control unit (90) is configured, in response to the roll-stabilization command and when the weight of the load of the transport ship (1) is equal to or greater than $0.8*P_{TC}$, to command the distribution device (60) to transfer the volume of the liquid to the roll-stabilizing tank (40) from the at least one front liquid tank (20) and/or the at least one rear liquid tank (30).

7. The transport ship (1) as claimed in claim 1, in which the total weight $P_{RT}$ of the at least one front tank (20) and of the at least one rear tank (30), when entirely filled with a liquid having a density of 1, represents between 2% and 8% of the empty weight $P_v$ of the transport ship (1).

8. The transport ship (1) as claimed in claim 1, in which the distribution device (60) is configured to transfer liquid from said at least one rear liquid tank (30) to the roll-stabilizing tank (40) via said central liquid tank (50).

9. The transport ship (1) as claimed in claim 1, in which the trim control system (10) comprises at least two front liquid tanks (20) spaced apart from one another and each located in the first third along the longitudinal axis (X-X') of the transport ship (1).

10. The transport ship (1) as claimed in claim 9, in which two of the at least two front liquid tanks are spaced apart along the longitudinal axis (X-X') of the transport ship (1).

11. The transport ship (1) as claimed in claim 1, in which the trim control system (10) comprises at least two rear liquid tanks (30) spaced apart from one another and each located in the final third along the longitudinal axis (X-X') of the transport ship (1).

12. The transport ship (1) as claimed in claim 11, in which two of said at least two rear liquid tanks (30) are spaced apart along the longitudinal axis (X-X') of the transport ship (1).

13. The transport ship (1) as claimed in claim 1, further comprising at least one sealed and thermally insulating tank (2) including at least one sealing barrier and at least one thermally insulating barrier-.

14. The transport ship (1) as claimed in claim 13, in which at least a part of a space surrounding the at least one sealed and thermally insulating tank (2) is an open space (6).

15. The transport ship (1) as claimed in claim 14, in which the roll-stabilizing tank (40) is adjacent to said open space (6).

16. A transport ship (1) comprising a trim control system (10) not in communication with a sea, the transport ship (1) having an empty weight $P_v$ of between 20% and 80% of a total weight $P_T$ thereof, and having a maximum load weight capacity ($P_{TC}$), calculated according to the following formula: $P_T=P_v+P_{TC}$, in which the trim control system (10) comprises:

at least one front liquid tank (20), said at least one front liquid tank being located in a first third along a longitudinal axis (X-X') of the transport ship (1), at least one rear liquid tank (30), said at least one rear liquid tank being located in a final third along the longitudinal axis (X-X') of the transport ship (1), a roll-stabilizing tank (40), the roll-stabilizing tank (40) having a larger dimension along a transverse axis (Y-Y') of the transport ship (1), and having at least one partition wall (42) arranged to slow a flow of liquid in the roll-stabilizing tank (40) along the transverse axis (Y-Y') of the transport ship, a distribution device (60), the distribution device being in communication with said at least one front liquid tank (20), said at least one rear liquid tank (30), and said roll-stabilizing tank (40), and being configured to distribute a volume of a liquid therebetween, the distribution device including at least one pump (69) and a plurality of valves; and wherein the roll-stabilizing tank (40) is located in the first third along the longitudinal axis (X-X') of the transport ship (1).

17. The transport ship (1) as claimed in claim 16, in which the distribution device (60) is configured to transfer liquid from the at least one rear liquid tank (30) to the roll-stabilizing tank (40) via a central liquid tank (50).

18. A transport ship (1) comprising a trim control system (10) not in communication with a sea, the transport ship (1) having an empty weight $P_v$ of between 20% and 80% of a total weight $P_T$ thereof, and having a maximum load weight capacity ($P_{TC}$), calculated according to the following formula: $P_T=P_v+P_{TC}$, in which the trim control system (10) comprises:

at least one front liquid tank (20), said at least one front liquid tank being located in a first third along a longitudinal axis (X-X') of the transport ship (1), at least one rear liquid tank (30), said at least one rear liquid tank being located in a final third along the longitudinal axis (X-X') of the transport ship (1), a roll-stabilizing tank (40), the roll-stabilizing tank (40) having a larger dimension along a transverse axis (Y-Y') of the transport ship (1), and having at least one partition wall (42) arranged to slow a flow of liquid in the roll-stabilizing tank (40) along the transverse axis (Y-Y') of the transport ship, a distribution device (60), the distribution device being in communication with said at least one front liquid tank (20), said at least one rear liquid tank (30), and said roll-stabilizing tank (40), and being configured to distribute a volume of a liquid therebetween, the distribution device including at least one pump (69) and a plurality of valves;

at least one sealed and thermally insulating tank (2) including at least one sealing barrier and at least one thermally insulating barrier; and wherein the roll-stabilizing tank (40) is located in front of the tank (2) along the longitudinal axis (X-X') of the transport ship (1).

19. A transport ship (1) comprising a trim control system (10) not in communication with a sea, the transport ship (1) having an empty weight $P_v$ of between 20% and 80% of a total weight $P_T$ thereof, and having a maximum load weight capacity ($P_{TC}$), calculated according to the following formula: $P_T=P_v+P_{TC}$, in which the trim control system (10) comprises:

at least one front liquid tank (20), said at least one front liquid tank being located in a first third along a longitudinal axis (X-X') of the transport ship (1), at least one rear liquid tank (30), said at least one rear liquid tank being located in a final third along the longitudinal axis (X-X') of the transport ship (1), a roll-stabilizing tank (40), the roll-stabilizing tank (40) having a larger dimension along a transverse axis (Y-Y') of the transport ship (1), and having at least one partition wall (42) arranged to slow a flow of liquid in the roll-stabilizing tank (40) along the transverse axis (Y-Y') of the transport ship, a distribution device (60), the distribution device being in communication with said at least one front liquid tank (20), said at least one rear liquid tank (30), and said roll-stabilizing tank (40), and being configured to distribute a volume of a liquid therebetween, the distribution device including at least one pump (69) and a plurality of valves; and wherein the roll-stabilizing tank (40) is located above the at least one front liquid tank (20) along a vertical axis (Z-Z') of the transport ship (1), the vertical axis (Z-Z') of the transport ship (1) being perpendicular to the longitudinal axis (X-X') and to the transverse axis (Y-Y') of the transport ship (1).

* * * * *